United States Patent [19]

Ammon et al.

[11] 4,184,735

[45] Jan. 22, 1980

[54] DISCRETE CONNECTOR

[75] Inventors: J. Preston Ammon; Harry R. Weaver, both of Dallas, Tex.

[73] Assignee: Elfab Corporation, Dallas, Tex.

[21] Appl. No.: 907,977

[22] Filed: May 22, 1978

[51] Int. Cl.[2] ..... H01R 13/42

[52] U.S. Cl. ..... 339/217 S

[58] Field of Search ..... 339/176 MP, 217 R, 217 S, 339/221 R, 221 M

[56] References Cited

U.S. PATENT DOCUMENTS

| | | | |
|---|---|---|---|
| 3,212,047 | 10/1965 | McDonough | 339/217 S |
| 3,412,369 | 11/1968 | Fox | 339/217 S |
| 3,444,504 | 5/1969 | Lynch et al. | 339/221 R |
| 3,530,422 | 9/1970 | Goodman | 339/176 MP |
| 3,601,775 | 8/1971 | Longenecker et al. | 339/176 MP |

FOREIGN PATENT DOCUMENTS

| | | | |
|---|---|---|---|
| 1398183 | 6/1975 | United Kingdom | 339/176 MP |

*Primary Examiner*—Neil Abrams

*Attorney, Agent, or Firm*—Crisman & Moore

[57] ABSTRACT

Contacts and receiving sleeves within a discrete connector insulator are sized to permit the contacts to be inserted into the sleeves of the insulator and secured therein by a small force applied to the top of the contacts. Receiving sleeves formed in the insulator are constructed to permit the contacts to be top loaded therein and lightly forced over detent means comprise a downwardly facing shoulder having an upper body portion tapering to the edge of the shoulder region complementarily formed for abutting engagement against the insulator shoulder for securing the contact in the insulator. The contacts are inserted into the insulator simultaneously while depending from a common support strip for facilitating assembly of the connector. The connector receives and electrically connects a mating printed circuit board through insertion thereof into the upper part of the insulative housing. The assembled discrete connector of the present invention permits removal of individual contacts from the connector for repair by the insertion of a contact receiving tool into the contact sleeve in the insulator for moving the collar portion of the contact laterally away from the insulator detent shoulder and permitting its upward removal therefrom.

9 Claims, 4 Drawing Figures

DISCRETE CONNECTOR

BACKGROUND OF THE INVENTION

The invention relates to an electrical connector, and, more particularly, to a discrete electrical connector having contacts removably held in a mating configuration within sleeves formed in an insulator.

Certain prior art electrical connectors have been assembled by very tightly press fitting or molding contacts into receiving blocks of insulative material which form structural members to support the contacts and hold them rigidly within the insulative body. The prior art connector having contacts rigidly fixed within the insulator, are then mounted by bolting the insulator to a pair of spaced parallel rails, or by dropping the contact tails into holes in a mounting substrate and soldering them in place. Problems have arisen in substrate mounted connectors of this type in that generally the insulator forms the structural member which supports the contacts and the insulator cannot be removed after the connector is mounted to the substrate. Further, it is virtually impossible to remove individual ones of such prior art contacts from within the insulator and/or the mounting substrate in the event one of the contacts is damaged.

The prior art techniques for assembly of the aforesaid connectors are also relatively slow because of the time required to rigidly mount each individual contact into its receiving sleeve within the insulator. Certain prior art connectors have overcome this problem by providing for simultaneous insertion of rows of contacts held together on strips into receiving sleeves which hold them in position within the insulator. Simultaneous contact insertion greatly speeds the connector assembly process and the generally light insulator/contact holding force typical of such assemblies enables insertion of the contacts into the insulator by hand eliminating the need for mechanical pressing apparatus. Such contact-insulator assemblies are oftentimes typical of the connectors which are press fitted into contact receiving apertures in a mounting substrate. Such a connector is set forth and described in co-pending patent application Ser. No. 770,578 entitled "Electrical Connector and Method of Fabrication and Assembly" and assigned to the assignee of the present invention. Likewise issued U.S. Pat. No. 4,045,868 issued Sept. 6, 1977 and assigned to the assignee of the present invention and entitled "Method of Fabrication and Assembly of Electrical Connector", sets forth and describes one method of providing a press fit electrical connector in the manner set forth above.

A trend in the development of the substrate mounted connector art is that of using structures which permit the removal of the insulator from mounted contacts. Certain prior art discrete connectors have included insulators adapted for tightly holding top loaded contacts in sleeves formed therein and, in certain instances, have been used as the seating tool for press fitting the contacts in this configuration. Such an approach is illustrated in U.S. Pat. No. 3,530,422, to David S. Goodman, entitled "Connector and Method for Attaching Same to Printed Circuit Board". The connector described in the Goodman Patent, includes contacts having transverse shoulder portions which are top loaded down into slots in the insulator. The contact tails are pulled through to seat the contacts, and the lower shoulder portion of each contact is twisted 90 degrees to lock each contact into the insulator bottom and the relatively large outwardly extending shoulder of the contact. The contacts can then be press fitted into apertures in a substrate by applying a force to the top of the insulators. Once the contacts have been press fitted, it is impossible to remove the insulator to expose individual ones of the contacts for repair. Similarly, each of the contacts are locked into the insulator to permit its individual removal therefrom.

In many prior art discrete connector assembly operations, the contacts are top loaded into the insulator with requisite force for preliminarily securing the contact therein and then a pulling force is applied to the bottom tail of the contacts relative to the insulator to seat the contact securely therein. Such "pull-home" forces are generally substantially equivalent to the "push-out" force of the contact in the insulator and require additional tooling to effect the pull-home operation. Most pull-home fixtures are adapted for engaging and pulling contacts one at a time rather than in a series. Such an operation is both time consuming and imparts higher cost to the assembly. It may also be observed that when the connector of certain of these discrete assemblies is mounted upon a printed circuit board, the contact may be designed to be removed for purposes of repair. In such connectors, the push-out force thereof is generally equivalent to the push-in force due to the type of mating configuration. However, the push-in force is optimally as low as possible to eliminate deformation of any of the components during assembly, and, therefore, the push out force is also relatively low.

The connector and method of manufacture of the present invention is especially adapted for the improved assembly and housing of contacts into an insulator to comprise a discrete connector. The present connector and method overcome many of the disadvantages of the prior art by providing an insulative housing, which permits simultaneous loading of removable contacts from the top with relatively small push-in forces sufficient to seat the contacts therein, and yet lock the contacts from the top with relatively small push-in forces sufficient to seat the contacts therein, and yet lock the contacts into the seated configuration to establish high push-out forces. In addition, the contacts may be removed from the insulator with a minimum push-out force or damage to the insulator by the insertion of the appropriate removal tool into the top of the insulator. Since the contacts are held within the insulator through detent means formed therein, the connector of the present invention permits a wider latitude of rigidity and structural integrity to the contact insulator assembly than previous discrete connectors of related design, and yet removal of the contacts from the insulator is facilitated with much less push-out force than conventionally possible.

SUMMARY OF THE INVENTION

The invention relates to a connector and method of manufacture and assembly which includes removable contacts top loaded and secured within sleeves of a discrete connector-insulator. More particularly, one aspect of the invention involves a contact for a discrete electrical connector, wherein a plurality of contacts having upper mating portions are formed, oriented and are simultaneously inserted into and seated within the sleeves of an insulative housing of the discrete connector. Each contact includes a transversely extending collar portion intermediate thereof for abuttingly engaging a mating shoulder within each insulator sleeve. The collar may be integrally formed with the contact for snapping past detent means formed in the side wall of the insulator housing. The contact is further adapted for being engaged by a removal tool positioned laterally thereagainst to pivoting the collar outwardly past the detent means of the insulator for removal of the contact.

In another aspect, the invention includes an electrical connector comprising an insulative housing including transversely extending shoulders having relatively small surface areas for serving as a detent means for securing a plurality of contacts top loaded into the insulator. The sleeves are spaced for subsequent alignment with apertures in a mounting substrate. The contacts are secured within the insulator sleeves by the downwardly facing shoulder thereof abutting the collar on the contact. The contact collar is seated against the shoulder in the sleeve to provide a mating configuration for withstanding axial push-out forces transmitted through the contact.

In another aspect, the invention includes a discrete electrical connector comprising an insulative housing having contact receiving sleeves spaced for registration with apertures in a mounting substrate and a plurality of removable contacts secured within the sleeves of the insulative housing. The electrical connector may be of the card edge or mating connector type. The elements of the connector of the present invention facilitate its repairability in that once the contacts have been secured within the insulator and mounted to the substrate, each contact may be replaceably removed from within the insulator by inserting a contact removal tool through the top of the insulative housing. Damaged contacts may then be individually removed from the mounting configuration for replacement without affecting the mounted discrete connector.

In yet another aspect, the invention includes the method of assembling an electrical connector with an insulator having a plurality of contact receiving sleeves formed therethrough, by the simultaneous installation of contacts. Discrete contacts adapted for secured positioning within the insulator are inserted into the insulator sleeves through the top portion. A transversely extending portion of each contact is then seated against and abuttingly engages a shoulder formed in each sleeve. Protruding portions of the contacts are guided into and electrically connected with aligned plated receiving apertures in the substrate.

The assembly of the electrical connector is further facilitated by fabricating the contacts of the discrete connector on a common support strip and inserting all of the contacts on the strip into the insulator simultaneously. The contacts are secured within the insulator by snapping the contacts past detent means formed in the side walls of the insulator sleeve. Once the contacts are inserted, the support strip may be removed.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION

Figure 1:
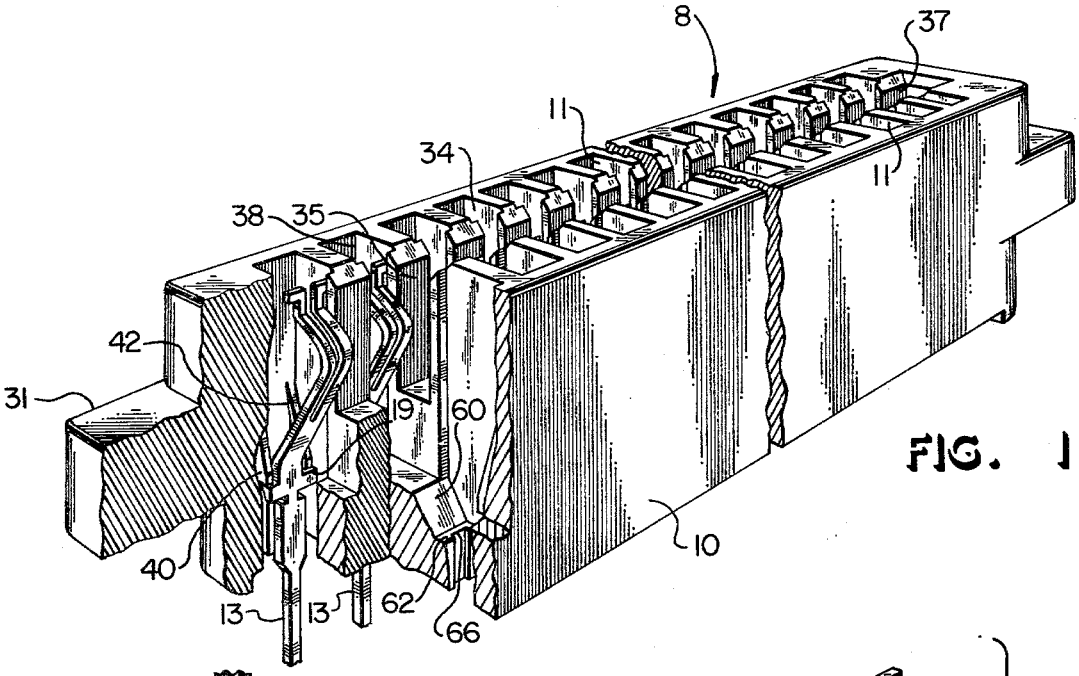
FIG. 1 is a fragmentary perspective view of an electrical connector constructed in accordance with the principles of the present invention with a part of the insulative housing cut away to illustrate the mating engagement between a sleeve and a contact.

Referring first to FIG. 1, there is shown a perspective view of one embodiment of an electrical connector 8 constructed in accordance with the principles of the present invention. The connector 8 includes an insulator 10 having a plurality of contact receiving sleeves 11 formed therethrough and contacts 13 seated therein. The configuration of one embodiment of a contact 13 having a mating upper portion is shown most clearly in FIG. 3, as discussed in more detail below. The mating configuration between the contact and the insulator of the present invention permits the structural interengagement and rigidity of a permanently secured contact akin to that of a contact molded into an insulator or a certain bottom loaded contact-insulator configurations. However, the present invention permits the upward removal of the contact from the insulator sleeve for repair. In this manner, the apparatus of the present invention permits the construction of a discrete connector having the advantages of contact replacement for repairability with the inherent reliability associated with discrete connectors manifesting high contact push out forces.

Figure 3:
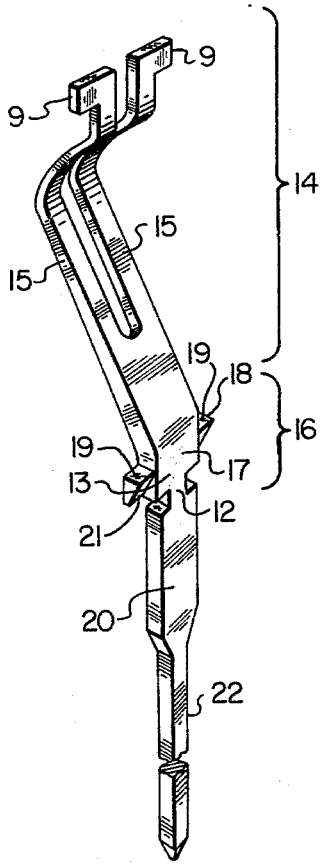
FIG. 3 is a perspective view of one of the contacts shown in FIG. 1.

Referring now to FIG. 3, each contact 13 of this particular embodiment includes a solid, elongaged post structure having a connector portion 14 comprised of a pair of upwardly extending, transversely deflectible, gripping times 15 forming the upper mating end. There is shown immediately beneath the tines 15 the construction of an intermediate contact section 16 which includes a central body portion 17 formed with a generally transversely extending collar region 18. The collar region 18 is formed with a apair of generally flat, upwardly facing, load bearing shoulders 19 formed with a side portion 21, having a downwardly facing taper, as will be discussed in more detail below. Immediately beneath the collar region 18 of the contact 13 there is formed a necked portion 12 from which depends a shank portion 20, which is adapted for insertion into a lower sleeve portion of the insulator 10.

Still referring to FIG. 3, immediately beneath the shank portion 20 there depends a tail portion 22 of generally square, reduced cross section. Tail portion 22 comprises a lower electrical interconnection region of the contact 13 adapted to receive automatically wrapped wire interconnection. It should be noted that the contacts of this particular embodiment are adapted for electrical and mechanical engagement with a printed circuit board inserted between pairs thereof. In construction, the upper tines 15 of the contact 13 are thus preferably plated for electrical interengagement with such a conductive section of a printed circuit board.

Figure 2:
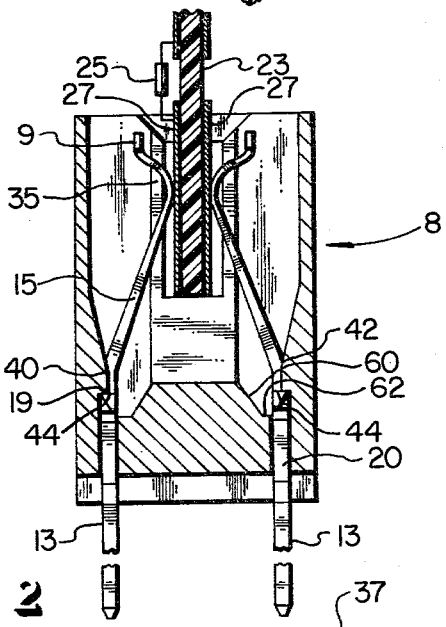
FIG. 2 is an enlarged, side elevational cross sectional view of the electrical connector of FIG. 1, illustrating the positioning of a pair of contacts therein.

Referring now to FIG. 2, there is shown an enlarged cross section of the connector of FIG. 1 with a printed circuit board 23 inserted in mating engagement. The upper part of the board 23 mounts a number of electrical components 25 which are connected to one another and to an array of plated edge finger terminations 27 by conventional printed circuit techniques. The fingers 27 are electrically connected to those points of the printed circuit board circuitry which must be interconnected to external circuits. The function of the embodiment of the connector shown in this embodiment is to terminate and to provide electrical connection to the plated edge finger terminations 27 on the board 23. The connector illustrated is of the double readout type arranged to terminate a printed circuit board having contact fingers on both the front and rear surfaces of the edge. Connections are made by a plurality of the conductive metal contacts 13, one contact for each termination finger 27.

The upper connector portion 14 of the contact 13 shown herein is curved into a bowed configuration and is terminated at its end by a flange portion 19 lying in substantially the same plane as the shank portion 20. It may also be seen that the contact portion 14 is bifurcated into the two tines 15 as discussed above. The bifurcated section provides a more secure, positive, redundant engagement with the printed circuit board edge finger terminations; and the flange section facilitates secured seating of the contact 13 within the insulator, as discussed in more detail below.

Still referring to FIG. 2, there is also shown a cross-sectional view of the insulative housing 10 with a pair of contacts 13 secured therein. The housing 10 is preferably formed of moldable insulative material such as plastic and includes an outer shell 31 which is open at its top portion to allow the contacts 13 to be top loaded therein. The housing 10 is preferably divided into a plurality of sleeves 11 by generally vertical wall sections 34. Each sleeve 11 receives one of the contacts 13. An intermediate sidewall flange portion 35, extends orthogonally across the innermost portions of wall sections 34 engages the flange 19 of each tine 15 of the contact 13 as it is received therein. In this manner each contact 13 is preloaded into the position shown by the sidewall 35 of the insulative housing. Thus, the space between opposing bowed portions of the contacts 13 is less than the thickness of the printed circuit board to be connected so that the engagement pressure between the contact 13 and a termination finger 27 is sufficient to effect a reliable interconnection. It should also be understood at this point that although the connector of the invention illustrates the use of opposed contact pairs, it might only include a single row of contact terminals for engagement with fingers formed on only one side of a printed circuit board.

Referring again to FIG. 1, there is shown more clearly the insulator 10 and the orthogonal side wall portions 34 and 35 of the sleeve 11, as well as a central elongated slot 37 constructed intermediately through the insulator 10 for receiving the printed circuit board 23 therein and between opposing sleeves 11. Each sleeve 11 contiguous to the slot 37 includes a generally rectangular top opening extending into a generally rectangular upper sleeve portion 38. Each upper sleeve portion 38 includes detent means comprising in this particular embodiment a pair of detent shoulders 40 and 42 formed in parallel spaced relationship upon outer lateral portions of the sleeve 11 and adjacent the side walls 34—34 of each of said sleeves. The detent shoulders 40 and 42 are comprised of inclined ledge sections similar to narrow ramps, tapering downwardly and spaced one from the other a distance slightly greater than the width of the contact body portion 17 and narrower than the contact collar region 18. The detent shoulders 40 and 42 terminate in a downwardly facing ledge, or shoulder 44 constructed to abut the upper facing shoulder 19 provided upon the contact dollar region 18 once the contact 13 is completely inserted and snapped into place therein. In this manner, the mating relationship between said contact and insulator shoulders provides an extremely high "push-out" force configuration through a rigid structural interengagement between the contact 13 and the insulator 10. This interengagement substantially prevents disassembly by upward removal of the contact 13 from the sleeve 11 without laterally deflecting the contact past its securing detent to permit removal. However, during assembly the lateral deflection of the contact 13 is facilitated as the contact collar region 18 slides downwardly along the inclined surfaces of the detent shoulders 40 and 42, therein minimizing the push in, or loading forces.

It may further be seen that once the contact 13 is seated beneath the detent shoulders 40 and 42, of the sleeve 11, the "preloading" force from the bifurcated upper portion 14 of the contact acts to push the intermediate body 16 thereof against the shell 31 of the insulator 10. In this manner, any looseness or "slop" in the mating contact sleeve engagement is compensated for by the contact collar 18 being biased toward a position securely under the detent shoulders 40 and 42. Fabrication tolerances are thereby expanded and assembly methods simplified.

Still referring to FIG. 1, it may further be seen that when a printed circuit board is plugged into the top opening of the finished connector 8, the fingers on the edges of the board 23 are engaged by the bowed sections of the contacts 13 with a preselected force. This ensures a positive electrical connection between the board and the contacts. Preloading contact flanges 19 against the orthogonal lip portions 35 allows a force to be exerted against the board 23 while still holding a relatively wide gap between the contact pairs to admit the board edge. The board does not have to perform all the contact flexure to get an adequate force of contact engagement. The preloading feature of the present invention also retains separation of the contact pairs from one another and does not permit accidental touching wien a board 23 is removed from the connector 8.

Figure 4:
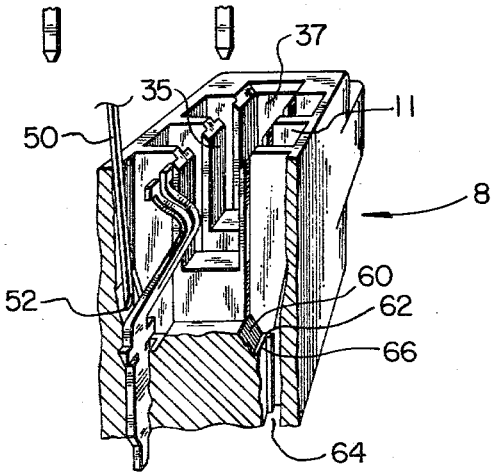
FIG. 4 is a fragmentary perspective view of the electrical connector of FIG. 1 illustrating the utilization of a contact removal tool inserted into a sleeve of the insulative housing to facilitate the removal of the contact therefrom.

Referring now to FIG. 4, an example of the removal of a contact 13 from the discrete connector 8 is shown, wherein a removal tool 50 is introduced into the sleeve 11 through the upper portion 38 thereof to slidably engage the intermediate portion 16 of the contact 13. The removal tool 50 includes a lower, tapered flange portion 52 adapted for slidably contacting the lower curvature of the connector portion 14 of the contact 13 between said lower portion and the side wall of the sleeve 11. Thus, the tool 50 is pushed downwardly to a position between the detent shoulders 40 and 42, adjacent the body portion 17 of the contact and applies a lateral pressure to deflect the contact inwardly toward the opposite side of the insulator 10. Such lateral movement causes the contact collar region 18 to be deflected outwardly from the detent shoulders 40 and 42, whereby the contact may be moved upwardly for removal from the insulator. It should be noted that the insertion of the removal tool behind the contact 13 of the embodiment shown is constructed to cause a plastic deformation of the necked portion 12 of the contact, as will be discussed in more detail below.

Referring again to FIG. 3, the necked portion 12 of the contact 13 is shown more clearly. The taper of the downwardly facing side portion 21 of the contact shoulder 19 acts in combination with the necked portion 12 to facilitate assembly of the connector of the present invention, as well as its disassembly, or repair. The tapered side portion 21 is inclined at an angle generally complementary to the angle of the upwardly facing taper of the detent shoulders 40 and 42 whereby the sliding engagement therebetween is facilitated when the contact 13 is inserted into the sleeve 11. The aforesaid sliding engagement necessitates the deflection of the contact 13 inwardly during this assembly step and the necked portion 12 facilitates the bending thereof within the elastic limits of the contact material and with a minimum of "push in" force.

Referring now to FIG. 2, wherein the contact 13 is shown seated beneath the detent shoulders 40 and 42, it may be seen that an intermediate region of the sleeve 11 includes a slanted wall section 60 and a horizontal section 62. The horizontal section 62 terminates adjacent a relatively narrow, vertically depending lower sleeve portion 64 forming an upper edge 66 therebetween. The lower sleeve 64 is constructed for receiving the shank portion 20 of the contact 13 therein. The contact 13 is constructed for flexing within its elastic limits, above the shank 20 during assembly insertion. Once the contact is seated within the sleeve 11, the edge 66 serves as a means for imparting plastic deformation across the region 12 when a removal tool 50 is inserted behind the assembled contact. The tool 50 causes the contact 13 to be flexed inwardly across the edge 66 which abuts the necked portion 12 of the contact. The slanted wall 60 is spaced sufficiently from the contact 13 to permit it to be bent across the edge 66 beyond its elastic limit and thereby deform it outwardly of the detent shoulders 40 and 42. The deformed contact 13 can then be pushed inwardly and out of the insulator 10 for replacement.

In the assembly of the present invention, it is preferable to insert the contacts 13 into the insulator sleeves 11 with a plurality of contacts joined together on a common support strip. The contacts may be formed on a continuous strip of conductive material from which the contacts are stamped and therein provided in enterengagement with said support strip for subsequent separation therefrom by deflection as is conventional in the assembly of contact systems. The contacts 13 as shown herein are thus joined to a support strip (not shown) atop the bifurcaled tine 15 thereof during assembly. Such an operation is facilitated by first supporting the insulator 10 on the upper surface of a backup board (not shown) so that each sleeve 11 is positioned above and in vertical lineup with relatively large clearance holes formed into the backup board. Each of the contacts 13 in a row are properly spaced from one another during fabrication with the tails 22 of each of the contacts 13 inserted into the top openings of the sleeves 11 so that all of the contacts on the strip are inserted simultaneously. As the contacts 13 are inserted, the square portions of the tails 22 pass relatively freely down through the openings 11 while the shank portions 17 pass freely along the sides therein. Once the contact collar region 18 is positioned upon the detent shoulders 40 and 42, a slight increase in pressure will be required to insert the remaining portion of the contacts 13 for seating within the sleeves 11. Once the contact shoulders 19 pass the detent shoulders 40 and 42, the contact 13 will snap into position from the preload force developed from the flange 9 abutting the insulator lip 35. The preload force raises the contact 13 to a position beneath detent shoulders 19, securely seating the contact 13 within the insulator 10. The support strip supporting the contacts may then be flexed and removed therefrom, as is conventional in the art. Contacts are similarly positioned in each of the two rows of sleeves 11 in the insulator to comprise mating pairs juxtaposed the intermediate slat portion 15 therethrough.

The insulator 10 having rows of contacts 13 secured therein becomes discrete connector 8 and is ready for assembly to a mounting substrate with the tail portions 22 of each contact 13 depending therefrom. The contacts 13 may be inserted into the mounting substrate through insertion in contact-receiving holes formed in registry with the depending contact tail portions 22. It may thus be seen that the connector of the present invention provides an insulator 10 which serves as the structural member and holding fixture for the connector in the same manner as all discrete connectors. However, the method and apparatus of the present invention enables each contact to be removed from the mating sleeve 11 for repair, while facilitating assembly on a support strip.

Having thus described the invention in connection with certain specific embodiments thereof, it should be understood that further modifications may now suggest themselves to those skilled in the art and it is intended to cover such modifications as fall within the scope of the appended claims.

We claim:

1. An improved discrete electrical connector of the type having a plurality of contacts received within an insulative housing for mounting upon a planar substrate, wherein the improvement comprises:

an insulative housing having sleeves formed therethrough and open at the top for permitting the contacts to be inserted therein, said sleeves being formed with pairs of spaced detent shoulders, each having an upwardly facing tapering configuration to facilitate movement of a contact collar portion downwardly past said detent shoulders, said detent shoulders being transversely spaced to define an open area therebetween and including a downwardly facing ledge portion thereunder for retaining a contact collar portion beneath said detent shoulders, said housing also including a lower inside wall terminating in a generally horizontal edge to define a line of flexure for contacts inserted into said sleeves; and contacts positioned in each of said sleeves, each contact having a generally transversely extending collar portion intermediate thereof and a necked portion beneath said collar defining a flexure section thereacross for permitting transverse elastic flexure of the contact during positioning of said contact collar portions beneath said detent shoulders, said necked portion also defining a line of plastic deformation flexure adjacent said generally horizontal edge to permit permanent bending of a contact from beneath said detent shoulders for removal of a contact from a sleeve within the insulative housing.

2. The improved discrete connector as set forth in claim 1 wherein said upper mating portion of said contact includes a bifurcated tine configuration, each of said tines having an outwardly extending flange portion seated against a longitudinal section of said sleeve of said insulative housing.

3. The improved discrete connector as set forth in claim 2 wherein said longitudinal section of said sleeve of said insulative housing is comprised of an orthogonal wall flange receiving said contact flange thereagainst and preloading said contact within said sleeve.

4. The improved discrete connector as set forth in claim 1 wherein said collar portion is comprised of a pair of outwardly extending shoulders including an inwardly facing body portion having a downwardly facing taper constructed for slidably engaging said upwardly facing taper of said detent shoulders of said sleeves during contact insertion therein.

5. The improved discrete connector as set forth in claim 1 wherein said sleeves of the insulative housing are formed in paired rows for the reception of card edge contacts therein.

6. A discrete electrical connector comprising:

an insulative housing including an outer shell having side walls open at the top and a plurality of sleeves formed therethrough and spaced from one another for axial alignment with apertures in a mounting substrate, each of said sleeves including a lower inside wall terminating in a generally horizontal edge and a pair of detent shoulders having an upwardly facing tapered body portion and downwardly facing shoulders at the lower end thereof; and contacts positioned within each of said sleeves and including an intermediate transversely extending collar portion having an upwardly facing shoulder in abutting engagement with the downwardly facing detent shoulders at the lower end of the housing for resisting upward movement of the contact, said contacts each including a necked portion beneath said collar portion defining a flexure section thereacross for permitting transverse elastic flexure of the contact during positioning of said contact collar portion beneath said downwardly facing detent shoulders, said necked portion also defining a line of deformation flexure adjacent said generally horizontal edge to permit bending of a contact from beneath said detent shoulders.

7. The discrete connector as set forth in claim 6 wherein each of said contacts comprise an upper mating portion including a bifurcated tine configuration, each of said tines having an outwardly extending flange portion seated against a longitudinal section of said sleeve of said insulative housing.

8. The discrete connector as set forth in claim 7 wherein said longitudinal section of said sleeve of said insulative housing is composed of an orthogonal wall flange receiving said contact flange thereagainst and preloading said contact within said sleeve.

9. The discrete connector as set forth in claim 6 wherein said collar portion is comprised of a pair of outwardly extending shoulders including an inwardly facing body portion having a downwardly facing taper constructed for slidably engaging said upwardly facing taper of said detent shoulders of said sleeves during contact insertion therein.

* * * * *